US007814709B1

(12) United States Patent
Resech

(10) Patent No.: US 7,814,709 B1
(45) Date of Patent: Oct. 19, 2010

(54) PIPE BOOT

(76) Inventor: Ronald W. Resech, 67 Country Club Dr., Bloomingdale, IL (US) 60108

( * ) Notice: Subject to any disclaimer, the term of this patent is extended or adjusted under 35 U.S.C. 154(b) by 0 days.

(21) Appl. No.: 12/640,290

(22) Filed: Dec. 17, 2009

Related U.S. Application Data

(63) Continuation of application No. 12/504,016, filed on Jul. 16, 2009, now abandoned.

(51) Int. Cl.
*E04D 13/14* (2006.01)

(52) U.S. Cl. ..... 52/58; 52/98; 52/100; 52/198; 52/302.1

(58) Field of Classification Search ..... 52/58, 52/98, 100, 198, 199, 219, 302.1; 277/312, 277/314, 315; 285/3, 4, 42–44, 139.2, 139.3, 285/148.25, 192, 236
See application file for complete search history.

(56) References Cited

U.S. PATENT DOCUMENTS

| | | | |
|---|---|---|---|
| 1,317,446 | A | 9/1919 | Hollaender |
| 3,731,952 | A | 5/1973 | Elwart |
| 3,807,110 | A | 4/1974 | Kaminski |
| 3,866,950 | A | 2/1975 | Skoch |
| 4,120,129 | A | 10/1978 | Nagler |
| 4,211,423 | A | 7/1980 | Resech |
| 4,333,660 | A | 6/1982 | Cupit |
| 4,526,407 | A | 7/1985 | Kifer |
| 4,563,847 | A | 1/1986 | Hasty |
| 4,570,943 | A | 2/1986 | Houseman |
| 4,664,390 | A | 5/1987 | Houseman |
| 4,768,812 | A | 9/1988 | Katz |
| 5,010,700 | A | 4/1991 | Blair |
| 5,018,748 | A | 5/1991 | Schalle |
| 5,036,636 | A | 8/1991 | Hasty |
| 5,176,408 | A | 1/1993 | Pedersen |
| 5,222,334 | A | 6/1993 | Hasty |
| 5,317,845 | A | 6/1994 | Bodycomb |
| 5,414,964 | A | 5/1995 | Bodycomb |
| D370,274 | S | 5/1996 | Menzies |
| 5,588,267 | A | 12/1996 | Rodriguez |
| 5,826,919 | A | 10/1998 | Bravo |
| 5,988,698 | A | 11/1999 | Bravo |

(Continued)

FOREIGN PATENT DOCUMENTS

| | | |
|---|---|---|
| DE | 2360538 | 12/1973 |

(Continued)

OTHER PUBLICATIONS

Aztec Washer Company, Standard Master Flash®, www.aztecwasher.com/standard-flash.html; 2009.

(Continued)

*Primary Examiner*—Robert J Canfield
*Assistant Examiner*—Matthew J Smith
(74) *Attorney, Agent, or Firm*—Robert L. Marsh

(57) ABSTRACT

A pipe boot includes a plurality of co-axial hollow cylindrical sections joined by an annular shoulder between successive sections. A first annular bead and a second annular bead surround each tubular section with the first annular bead positioned radially outward of each annular shoulder. The second annular bead is spaced a short distance from the second annular bead leaving an annular trough between them.

5 Claims, 4 Drawing Sheets

U.S. PATENT DOCUMENTS

| | | | |
|---|---|---|---|
| D436,157 | S | 1/2001 | Houseman |
| 6,306,046 | B1 | 10/2001 | Didszuhn |
| 2005/0055889 | A1 | 3/2005 | Thaler |
| 2007/0101664 | A1 | 5/2007 | Hoy |

FOREIGN PATENT DOCUMENTS

| | | | |
|---|---|---|---|
| EP | 1008701 | A1 | 6/2000 |
| GB | 2156919 | A | 10/1985 |
| WO | WO8504923 | | 11/1985 |
| WO | WO8809855 | | 12/1988 |
| WO | WO9100399 | | 1/1991 |

OTHER PUBLICATIONS

Carlisle Syntec Incorporated, Sure-Weld Roofing System, Sure-Weld Pre-Molded Pipe Flashing, SW-8A, 2007.

Johns Manville, JM EPDM Peel & Stick Pipe Boots, Apr. 2009; jm.com/roofing.

Firestone Building Products Company, Technical Information Sheet, UltraPly QuickSeam Pipe Boots, Firestone Item No. W56TPO3033, Jan. 25, 2007, Indianapolis, IN 45240.

GAF Materials Corporation, EverGuard Freedom TPO Self-Adhering Roofing Systems, 2004;1361 Alps Road, Wayne, NY 07470.

Tom Barrow Company, Flashings & Pipe Accessories, Portals Plus, Roof Flashings, Sillicone—Deck Mate (R), Atlanta, Albany, Ft. Myers, Jacksonville, Memphis, Nashville, Norcross, Orlando, Savannah, Tampa.

Mule-Hide Products Co., Inc, Mule-Hide Premolded EPDM Pipe Boots, Product Data Sheet, Jan. 1, 2007; P. O. Box 1057, Beloit, WI 53512-1057.

Robert Scharff and Terry Kennedy, Roofing Handbook, Second Edition, 2001, McGraw-Hill, New York, NY, ISBN 0-07-136058-1.

Portals Plus, Inc., Installation Instructions for Deckmate.

PIPE BOOT

The present application is a continuation of the applicant's co-pending application filed Jul. 16, 2009 and assigned Ser. No. 12/504,016. The present invention relates to a pipe boot for sealing around a cylindrical penetration extending through a roof, and to an improved pipe boot the length of which is easily cut to fit a given diameter of pipe.

BACKGROUND OF THE INVENTION

It is common for a flat roof, that is a roof having a surface that is substantially horizontal, to support various other structures such as air conditioners, heaters, signage, vents, stacks, and so forth. One of the most common members that extend through the surface of a flat roof is a pipe, and such pipes are available in certain predetermined inner diameters.

To seal a pipe extending through a roof against the leakage of water under a layer of roofing material applied to the surface of the roof, a pipe boot is provided. The pipe boot is made of a somewhat elastomeric material such as a vinyl, a rubber, or the like. The boot includes an upper portion that consists of a plurality of concentric generally cylindrical tubular portions stacked in descending diameters with a radial flange extending outwardly of the tubular portion having the largest diameter. The inner diameters of the tubular portions are chosen to fit around the outer diameter of commonly used pipe sizes.

To employ a pipe boot to seal a length a pipe extending through a roof and prevent water from getting under the roofing material applied to the surface of the roof, the pipe boot is cut to remove the stacked tubular portions that are smaller in diameter than that needed to fit around the given pipe. The boot is therefore cut to provide an opening that will fit snugly around the outer diameter of the pipe. Thereafter, the pipe boot is fitted over the length of pipe with the radial flange bonded to the roofing material applied to the surface of the roof. A hose clamp is then wrapped around the tubular portion that snuggly receives the pipe and tightened to provide a hermetical seal.

To provide a good seal around a pipe, it is desirable that the tubular portion fitted around the length of pipe have sufficient axial length to receive a hose clamp such that it will not slip off the end of the tubular portion over a period of time. It is therefore desirable that the cut to remove the smaller stacked diameters of tubular portions be made as near as possible to the annular flange that separates the tubular portion of the desired diameter from tubular portions of smaller diameters. Typically, the pipe boot is cut by a roofer at the site, and often the roofer inadvertently destroys the pipe boot because of the difficulty of providing an accurate cut that allows sufficient axial length of the desired tubular portion to receive a hose clamp. It would be desirable therefore to provide an improved pipe boot that could be more easily cut to the desirable size by a roofer working in the field.

SUMMARY OF THE INVENTION

Briefly, the present invention is embodied in a pipe boot having a body consisting of a plurality of generally co-axial cylindrical tubular sections stacked in successively smaller diameters with an annular planar shoulder between successive sections. A radial flange extends from the distal end of the largest tubular section. The invention includes a first annular bead around at least one of the cylindrical sections where the first annular bead is positioned radially outward of the outer diameter of the annular planar shoulder connecting to a smaller diameter tubular section. A second annular bead also extends around the same tubular section with the second annular bead spaced a short distance from the first annular bead leaving an annular trough between the first annular bead and the second annular bead. The second annular bead is also spaced sufficiently far from the nearest radially outwardly extending shoulder to receive a standard hose clamp between the second annular bead and the shoulder.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
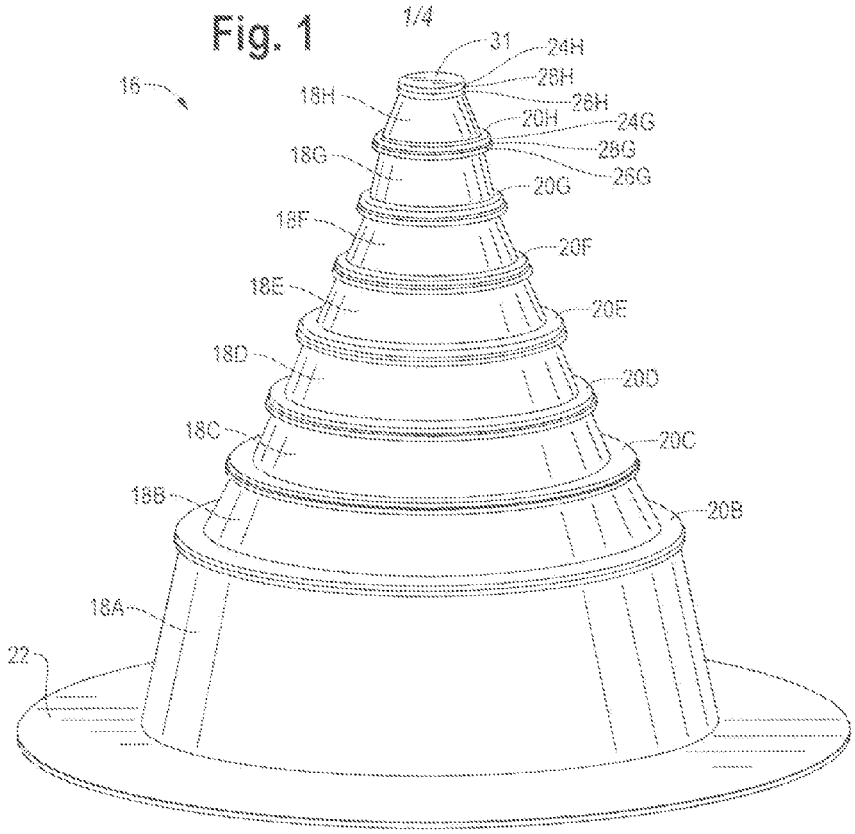
FIG. 1 is an isometric view of a boot in accordance with the present invention.
Figure 2:
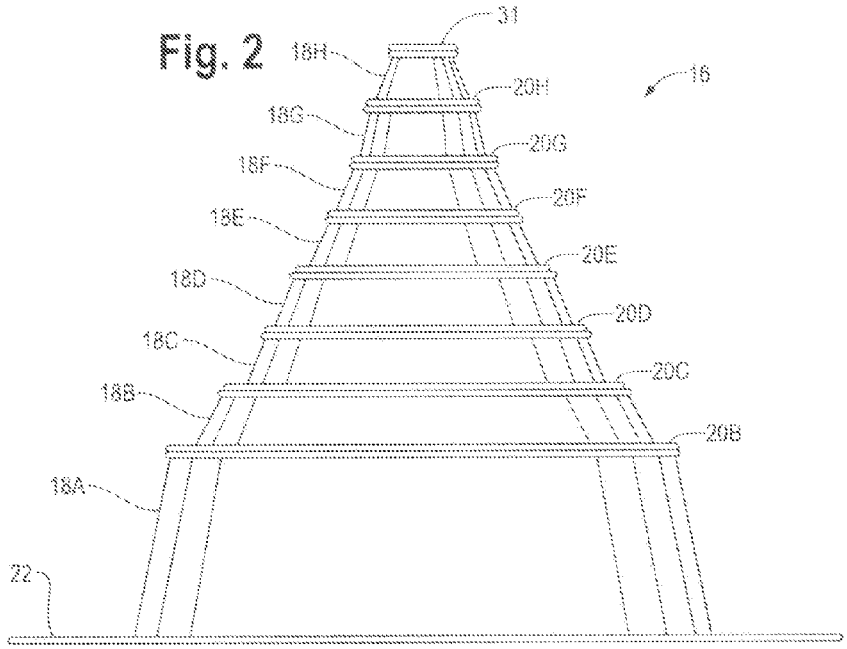
FIG. 2 is a side elevational view of the pipe boot shown in FIG. 1.
Figure 3:
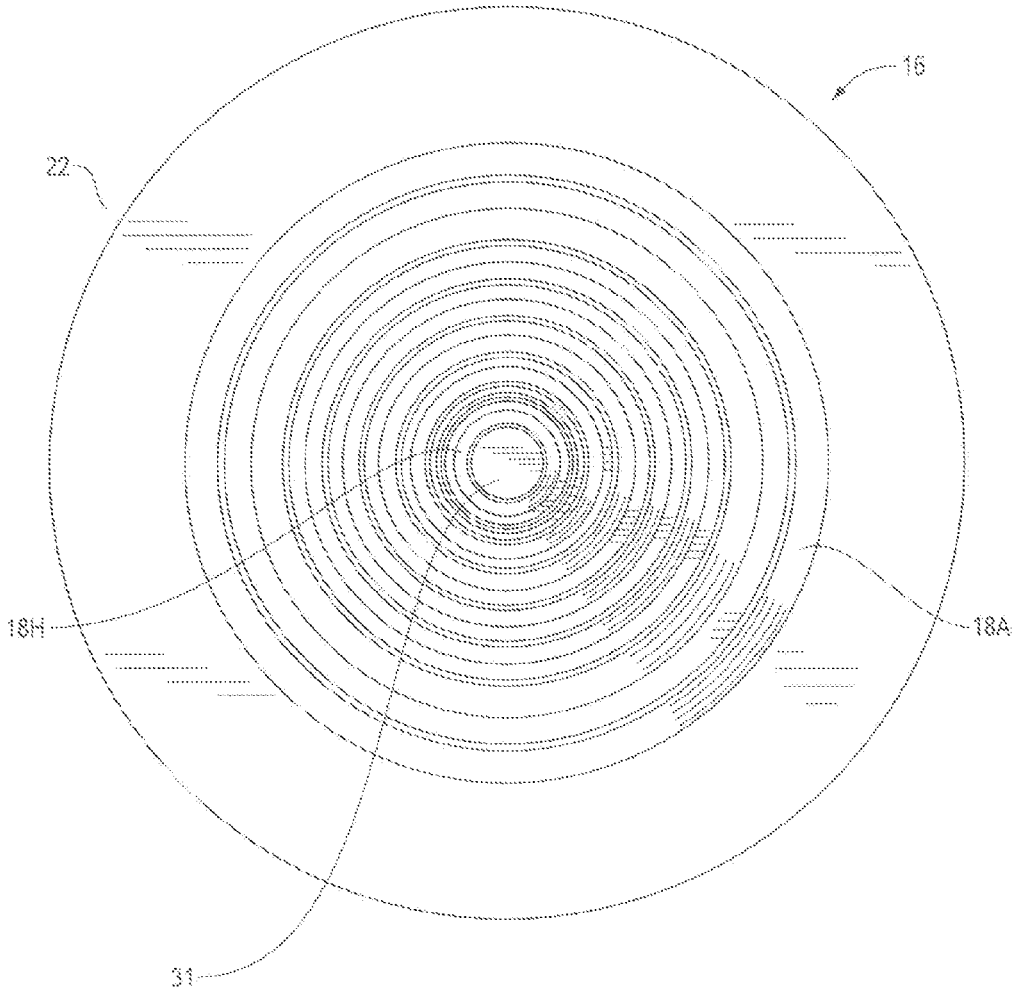
FIG. 3 is a top view of the pipe boot shown in FIG. 1.
Figure 4:
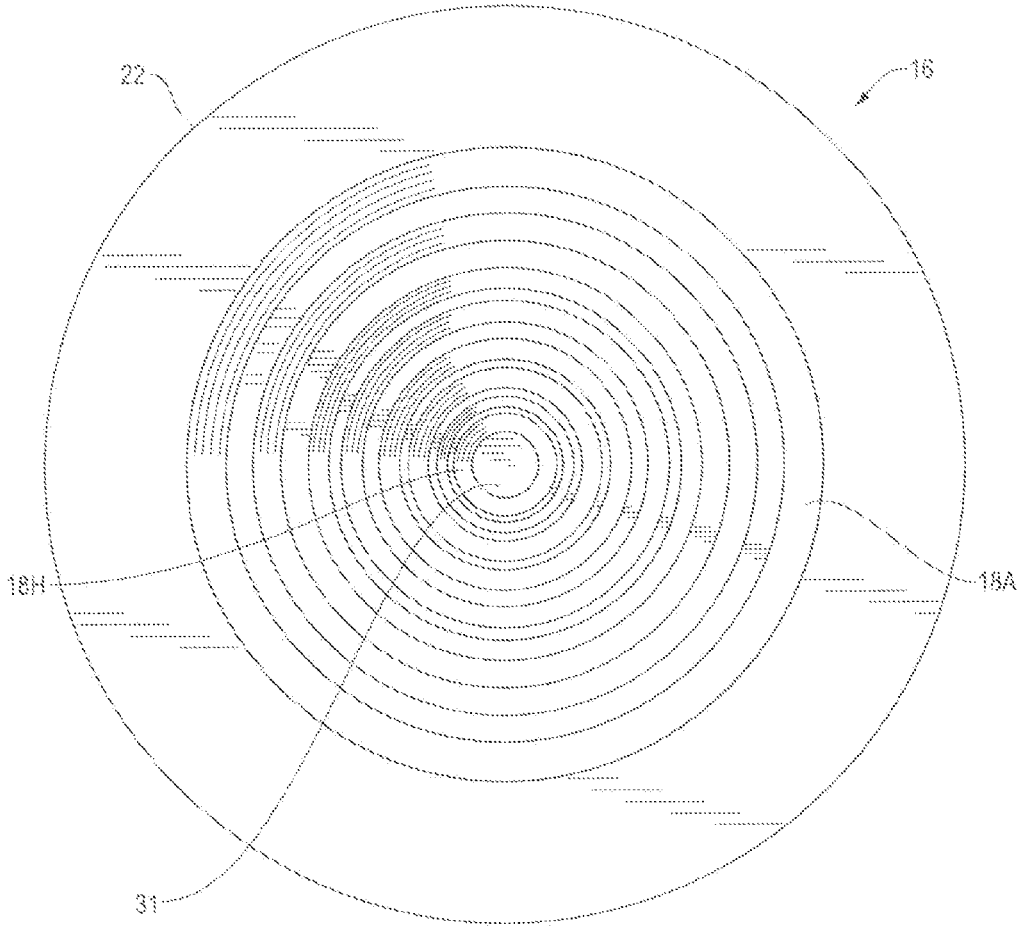
FIG. 4 is a bottom view of the pipe boot shown in FIG. 1.
Figure 5:
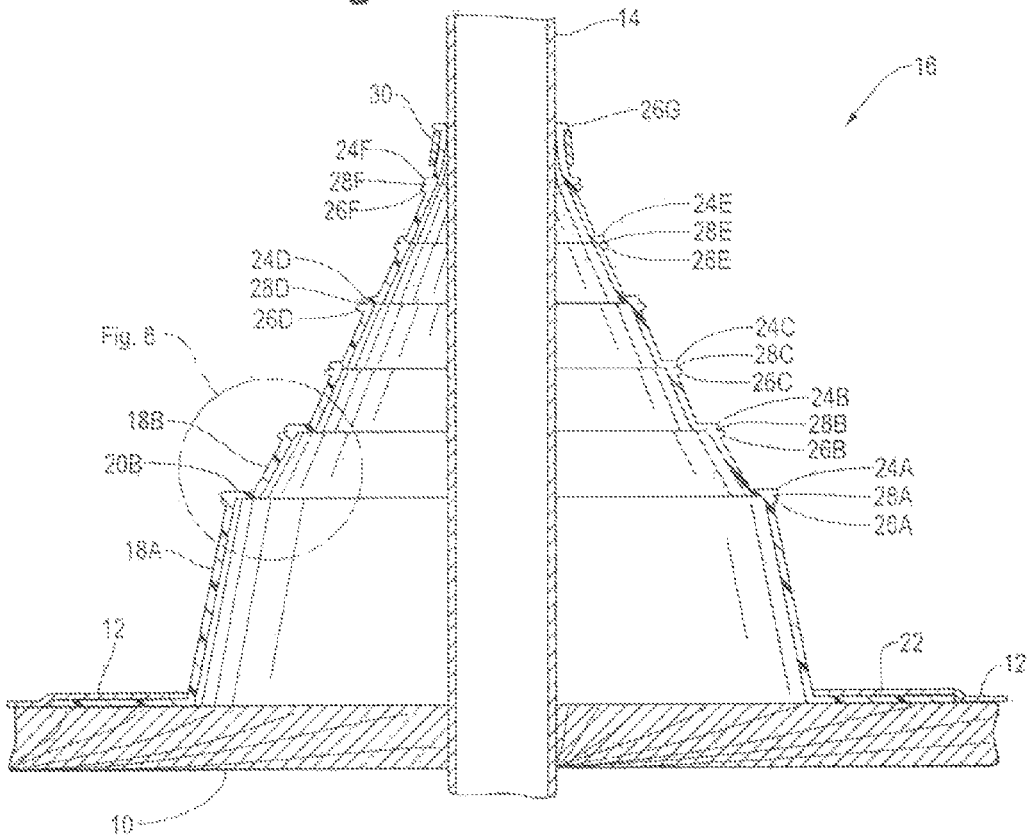
FIG. 5 is a cross-sectional view of a section of roof having a film of roofing material thereon, a length of pipe extending through the roof and the roofing material and a pipe boot in accordance with the present invention fitted around the pipe and against the upper surface of roofing material.

Referring to FIG. 5, a section of a flat roof 10 has a planar layer of water protecting roofing material 12 thereon. Extending vertically through the roof 10 and roofing material 12 is a length of pipe 14. Fitted around the circumference of length of pipe 14 and against the layer of roofing material 12 is a pipe boot 16 in accordance with the present invention.

Referring to FIGS. 1 through 6, the pipe boot 16 is made of a semi-rigid durable elastomeric material such as a rubber, vinyl, a TPO, or a PVC. The pipe boot 16 has a plurality of co-axial tubular sections 18A . . . 18H that are stacked in successively smaller diameters. Each of the tubular sections 18A . . . 18H is generally configured as a hollow cylinder, that is, having a generally cylindrical outer wall and a generally cylindrical coaxial inner wall with an inner diameter sized to fit around the outer circumference of a standard size pipe. The inner and outer walls of each section 18A . . . 18H may also be slightly frustoconical as shown. Pipe is manufactured with standardized inner diameters, such as six inches, five inches, four inches and so forth, but the outer diameter may be different depending on the material of which the pipe is made. The outer diameter of a six inch PVC pipe for example, is a little larger than the outer diameter of six inch copper tubing. The frustoconical sections 18A . . . 18H are configured to allow the narrow ends of each section to expand to accept pipes of different material. Accordingly, each section 18A to 18H has an inner diameter sized to fit around one of a standardized diameter pipe and the taper permits the section to receive pipe made of several types of materials.

Joining any two successive tubular sections is an annular radially extending shoulder 20B . . . 20H that extends radially outwardly from the lower end of a smaller diameter tubular section 20B . . . 20H to the upper end of a successively larger tubular section 18A . . . 18G. Extending radially outward from the distal end of the largest diameter tubular section 18A is an annular radial flange 22. An end panel 31 extends across the upper end the smallest section 18H of the boot 16.

Figure 6:
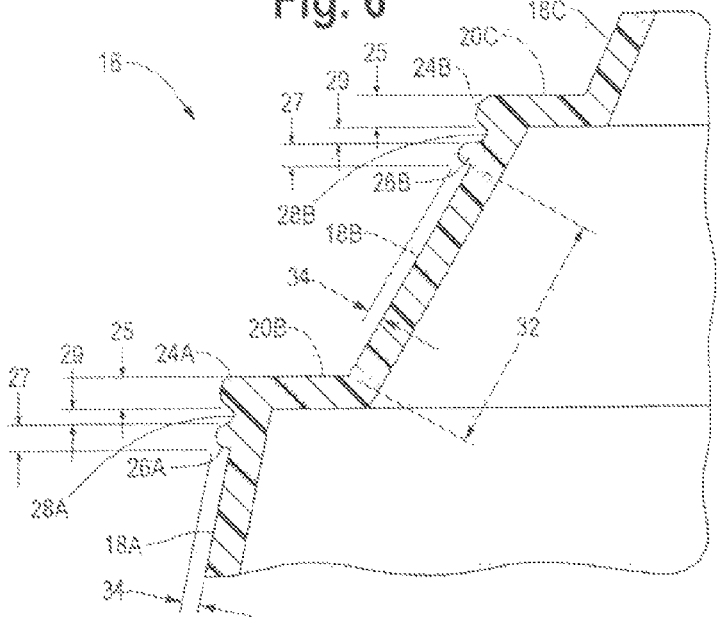
FIG. 6 is a fragmentary enlarged cross-sectional view of a portion of the pipe boot shown in FIG. 1.

As best shown in FIGS. 5 and 6, extending around the circumference of each of the tubular sections 18A . . . 18H is a first annular bead 24A . . . 24H, the first annular bead being positioned adjacent the upper end thereof. For each of the tubular sections except the smallest tubular section 18H, the first annular bead 24A . . . 24G is positioned radially outwardly of one of the radially extending shoulders 20B . . . 20H. The annular bead 24H around the smallest tubular section 18H is positioned radially outward of the end panel 31. Each first annular bead 24A . . . 24H, of which beads 24A and 24B depicted in FIG. 6 are representative of all, has a thickness 25 that is at least equal to the thickness of the radially inward shoulder 20B, 20C. For every tubular section 18A . . . 18H, a second annular bead 26A . . . 26H is provided. As best shown in FIG. 6, each of the second annular beads, of which 26A an 26B are again representative of all, is spaced a short distance 29 from the adjacent first annular bead. The second annular bead has a thickness 27 and a height 34 sufficient to provide a barrier for retaining a hose clamp 30 fitted around the associated tubular section 18A . . . 18H, as is further described below. Between each of the pairs of annular beads 24, 26 is an annular trough 28A . . . 28H. Also, each annular trough 28A . . . 28H has a width 29 that is the distance between the walls of the first and second beads that define the trough, that is sufficient to receive a cutting tool, such as a knife blade or a scissors, by which the pipe boot 16 can be cut along one of the troughs 28A . . . 28H. As can be seen in FIG. 6, the troughs 28A, of which troughs 28A and 28B are representative of all, is positioned axially below the nearby radial shoulder 20B . . . 20H. Finally, each second annular bead 26A . . . 26H is spaced from the nearest lower radially outwardly extending shoulder 20B . . . 20H (bead 26A is spaced from radial flange 22) a distance 32 sufficient to receive a standardly available hose clamp. Hose clamps are currently available in widths of five-sixteenths inch, one-half inch, or five-eighths inch, and therefore distance 32 should be at least five-sixteenths inches.

In the preferred embodiment, the pipe boot 16 is made of a vinyl having a thickness of 0.0625 inches throughout, including the various shoulders 20. The first beads 24A . . . 24H therefore have a thickness 25 of 0.0625 inches, the second beads 26A . . . 26H have thickness 27 of 0.145 inches, and the troughs 28A . . . 28G have a width 29 of 0.019 inches. The second annular beads 26A . . . 26G also have a height 34 of 0.040 inches to provide a barrier for retaining a hose clamp 30.

To employ the pipe boot 16, a roofer must cut the pipe boot 16 near the upper end of a tubular section 18 having an inner diameter sized to fit snuggly around a length of pipe 14. To maximize the length of the tubular section 18, the cut must be made as near as possible to the planar shoulder 20. A roofer who attempts to cut a prior art pipe boot is unaware of the exact thickness of the annular shoulder 20 and therefore is unable to determine the exact position to cut so as not to intercept the planar shoulder 20. The pipe boot 16 of the present invention, however, is provided with first and second beads 24, 26 that define the trough 28 there between that is positioned axially rearward of the adjacent shoulder 20. Accordingly, cutting the pipe boot 16 in one of the troughs 28 will cause the roofer's knife to avoid intersecting the shoulder and allow for a maximum axial length for the portion of the pipe boot 16 that snuggly receives a length of pipe.

Once the pipe boot 16 has been cut through a trough 28 of a tubular section 18, the second bead 26 will remain around the distal end of the cut pipe boot 16. The second annular bead 26 will assist in preventing the tearing of the material of which the pipe boot 16 is made and will also provide a barrier for retaining a hose clamp 30 which is applied around the circumference of the section 18 to seal the upper end of the pipe boot 16 against the outer circumference of a length of pipe 14.

After the smaller diameter cylindrical portions have been removed, the pipe boot 16 is fitted over the end of a vertically extending pipe 14 with the flange 22 end extending downward. The pipe boot 16 is moved downward along the pipe 14 until the flange 22 rests against the layer of roofing material 12. The flange 22 is then heat welded or bonded with an adhesive to the roofing material 12 to seal the boot 16 to the roofing material 12. A hose clamp 30 is then fitted around the smallest remaining tubular section 18 between the second bead 26 and the lower shoulder 20 and within the spacing 32 and tightened, thereby sealing the pipe boot 16 to the pipe 14.

While the present invention has been described with respect to a single embodiment, it will be appreciated that many modifications and variations may be made without departing from the spirit and scope of the invention. It is therefore the intent of the appended claims to cover all such modifications and variations that fall within the spirit and scope of the invention.

What is claimed:

1. A pipe boot comprising a unitary tubular body with a plurality of upwardly extending co-axial hollow cylindrical sections of successively smaller diameter, a plurality of radial shoulders with one of said plurality of shoulders between any two of said successive cylindrical sections, a first annular bead around an outer surface of each of said cylindrical sections, said first annular bead at a first end of each of said cylindrical sections and radially outward of one of said annular radial shoulders and having a width equal to a thickness of said one of said annular radial shoulders, a second annular bead around said outer surface of each of said cylindrical sections, said second annular bead spaced a short distance from said first annular bead leaving an annular arcuate trough between said first annular bead and said second annular bead, said annular trough having a width of at least 0.019 inch wherein such width is sufficient to receive a cutting tool for cutting said pipe boot along said trough, and said second annular bead spaced from a second end of each of said cylindrical sections a distance of at least five-sixteenths inch.

2. The pipe boot of claim 1 and further comprising a radial flange extending outward of a distal end of a largest diameter cylindrical section.

3. The pipe boot of claim 1 wherein one of said hollow cylindrical sections has an inner cylindrical wall having a diameter equal to an outer diameter of a length of pipe.

4. The pipe boot of claim 1 wherein each said annular trough is positioned axially below one of said annular radial shoulders.

5. The pipe boot of claim 1 wherein each of said second annular beads has dimensions sufficiently large to retain a hose clamp from sliding off an associated one of said cylindrical sections.

* * * * *